US005884423A

United States Patent [19]

Lo

[11] Patent Number: 5,884,423

[45] Date of Patent: Mar. 23, 1999

[54] VIBRATION SNOWING MECHANISM

[76] Inventor: Szu-Wei Lo, 7F-1, No. 3, lane 173, Liu-Ho Road, Pu-Li chen, Nan-Tou Hsien, Taiwan

[21] Appl. No.: 965,979

[22] Filed: Nov. 7, 1997

[51] Int. Cl.[6] ..... G09F 19/00

[52] U.S. Cl. ..... 40/410; 40/409

[58] Field of Search ..... 40/409, 410, 411, 40/414; 472/65

[56] References Cited

U.S. PATENT DOCUMENTS

| | | | |
|---|---|---|---|
| 3,117,394 | 1/1964 | Wenger | 40/409 |
| 5,098,084 | 3/1992 | Culver | 40/410 |
| 5,291,674 | 3/1994 | Torrence | 40/410 |
| 5,502,908 | 4/1996 | Powell et al. | 40/409 |
| 5,617,658 | 4/1997 | Chen | 40/411 |

*Primary Examiner*—Kenneth J. Dorner
*Assistant Examiner*—Marcus Dolce
*Attorney, Agent, or Firm*—Rosenberg, Klein & Bilker

[57] ABSTRACT

A vibration snowing mechanism is disclosed. It includes a base board, an upper fixing ring, a lower fixing board, a glass tube, a bottom sealing pad, multiple supporting columns, an upper fitting member, a lower fitting member, a screen assembly, a vibration linkage and multiple plastic granules. When a driving gear is rotated, the vibration linkage is vibrated up and down and a screen member of the screen assembly is also vibrated up and down. At this time, the multiple plastic granules pass through the orifices to drop down as snow.

5 Claims, 4 Drawing Sheets

VIBRATION SNOWING MECHANISM

BACKGROUND OF THE INVENTION

The present invention relates to a vibration snowing mechanism which creates snowing effect by way of vibration.

FIG. 1 shows a conventional glass water ball 1 including a base seat 11 and a transparent glass ball 1. A decoration 12 is disposed on the base seat 11 and the glass ball 1 is filled with a liquid 13. The decoration 12 of such glass water ball 1 is stationary so that the glass water ball 1 can only provide monotonous view.

SUMMARY OF THE INVENTION

It is therefore a primary object of the present invention to provide a vibration snowing mechanism in which by means of vibration, multiple plastic granules slowly drop down in the water as snow.

It is a further object of the present invention to provide the above vibration snowing mechanism in which several bulbs and a music bell can be added to create sound and light effect.

The present invention can be best understood through the following description and accompanying drawings, wherein:

DETAILED DESCRIPTION OF THE PREFERRED EMBODIMENTS

Figure 1:
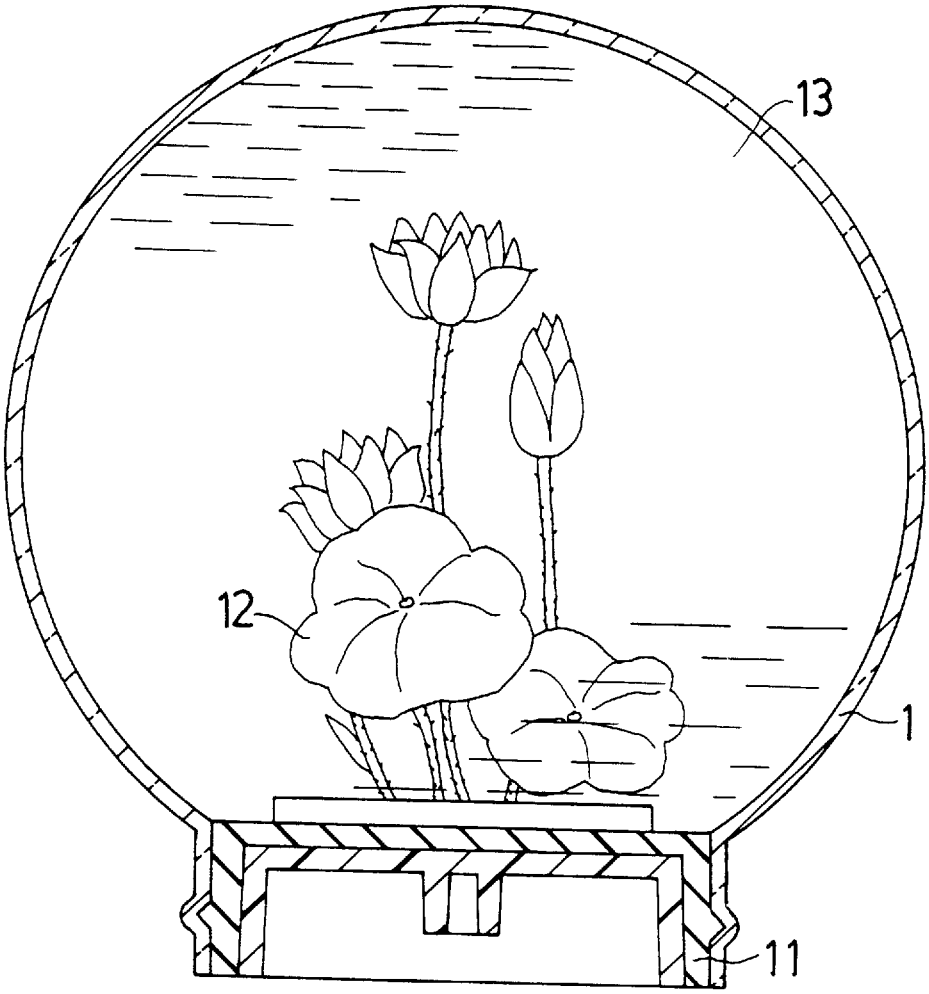
FIG. 1 PRIOR ART
FIG. 1 shows a conventional glass water ball.
Figure 2:
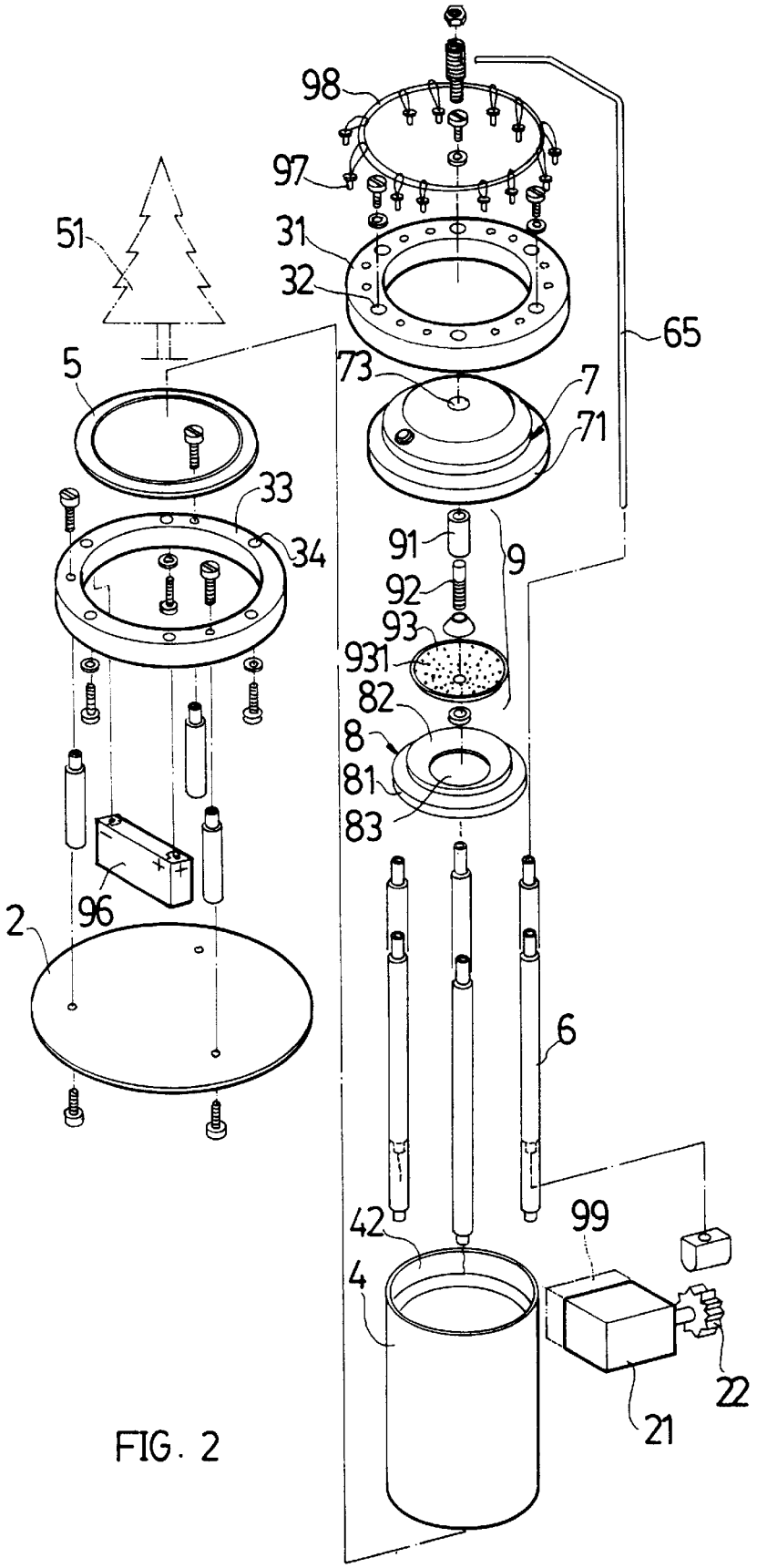
FIG. 2 is a perspective exploded view of the present invention.
Figure 3:
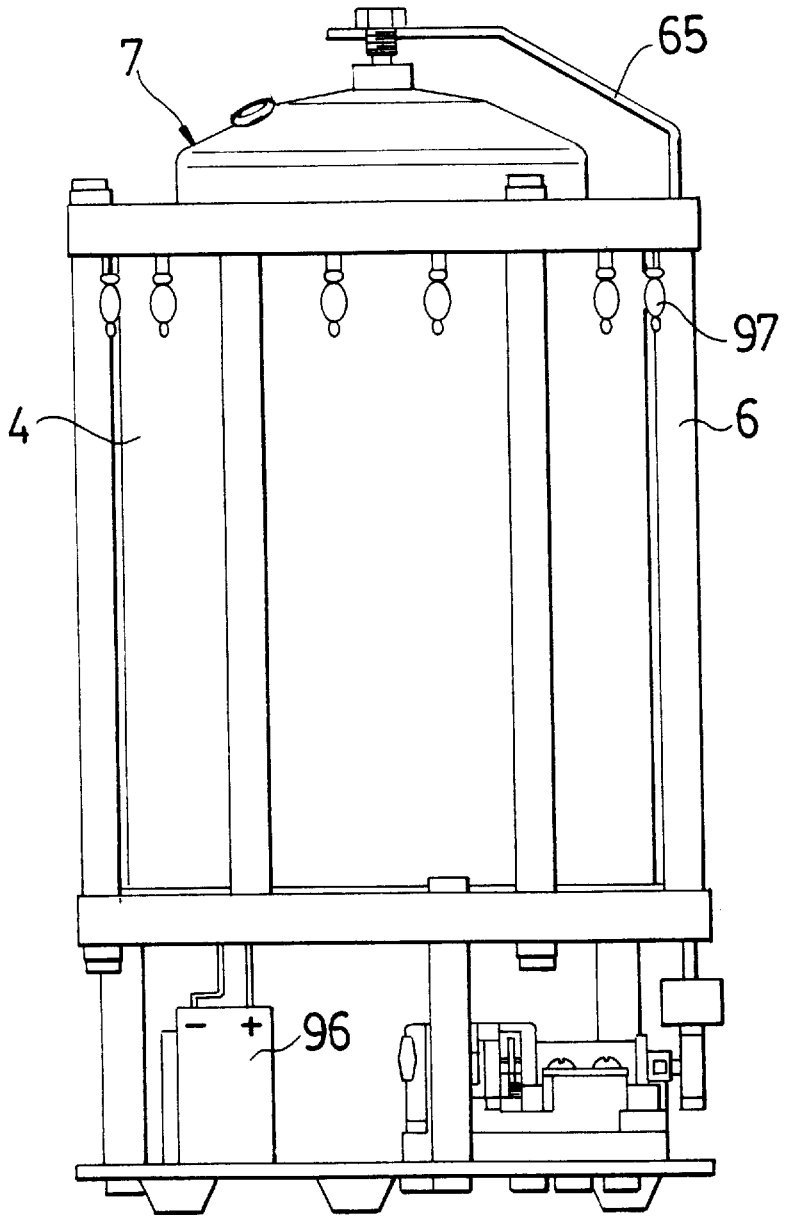
FIG. 3 is a side assembled view of the present invention.
Figure 4:
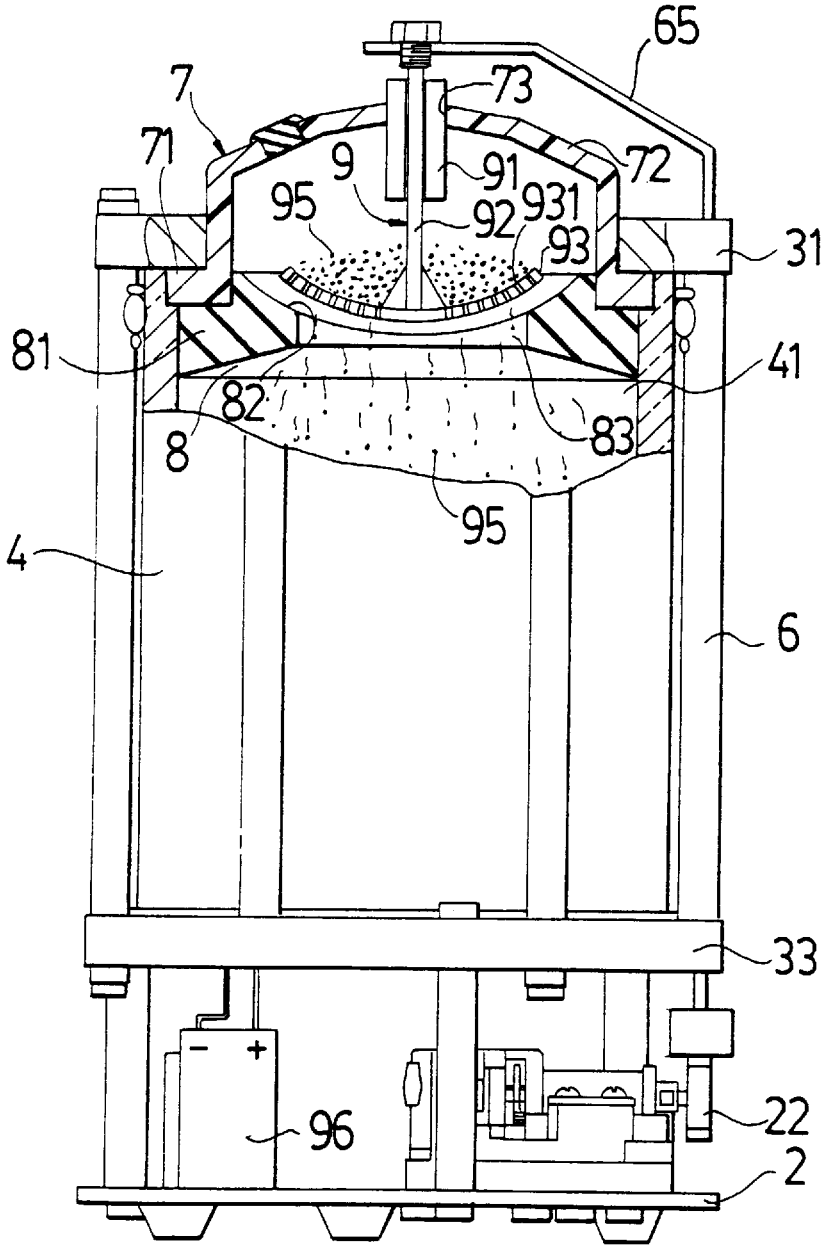
FIG. 4 is a sectional assembled view of the present invention.

Please refer to FIGS. 2 to 4. The snowing mechanism of the present invention includes a base board 2, an upper fixing ring 31, a lower fixing board 33, a glass tube 4, a bottom sealing pad 5, multiple supporting columns 6, an upper fitting member 7, a lower fitting member 8, a screen assembly 9, a vibration linkage 65 and multiple plastic granules 95.

The base board 2 is disposed with a driving means 21 having an extending driving gear 22. The driving means 21 can be a manually operated winding spring or an electric motor.

The upper fixing ring 31 has an inner and an outer diameter and is formed with multiple upper fixing holes 32.

The lower fixing board 33 is formed with multiple lower fixing holes 34 corresponding to the upper fixing holes and is retained above the base board.

The glass tube 4 is disposed between the upper fixing ring 31 and the lower fixing board 33 and is filled with a liquid 41. The upper end of the glass tube 4 is formed with an annular groove 42 for receiving the lower fitting member 8.

The bottom sealing pad 5 is disposed between the bottom end of the glass tube 4 and the lower fixing board 33 for avoiding leakage. A decoration 51 is disposed on the bottom sealing pad 5.

The supporting columns 6 are connected with the upper fixing ring 31 and the lower fixing board 33 for securing the same.

The upper fitting member 7 is formed with an upper flange 71, a recess 72 and a top hole 73 and is fitted with bottom end of the upper fixing ring.

The lower fitting member 8 is formed with a lower flange 81, a conic receptacle 82 and a central hole 83 and is secured at top end of the glass tube 4.

The screen assembly 9 includes a sleeve 91 fixed in the top hole of the upper fitting member, a rod member 92 vertically slidably fitted in the sleeve 91, and a funnel-shaped screen member 93 disposed at bottom end of the rod member 92 and formed with multiple orifices 931.

The vibration linkage 65 has one end connected with the driving gear 22 and another end fixed at top end of the rod member 92.

The diameter of the plastic granules (preferably white) is slightly smaller than the diameter of the orifices 931.

According to the above arrangement, when the driving gear 22 is rotated, the vibration linkage 95 is vibrated up and down, whereby the screen member 93 is also vibrated up and down. At this time, the multiple plastic granules 95 pass through the orifices 931 to drop down as snow.

The snowing mechanism of the present invention can further include a cell (or battery) 96, several bulbs 97 disposed in the fixing holes 32 of the upper fixing ring 31, and multiple wires 98 disposed in two of the supporting columns 6 to connect the bulbs 97 with the cell 96. In addition, the snowning mechanism can further include a music bell 99 for emitting music when the driving means 21 is activated.

After all the plastic granules 95 drop down, the entire vibration snowing mechanism can be placed upside-down. At this time, the plastic granules 95 will pass through the central hole 83 of the lower fitting member 8 and enter the recess 72 of the upper fitting member 7 along the screen member 93. Then, the snowing mechanism is again reversed into home state.

It is to be understood that the above description and drawings are only used for illustrating some embodiments of the present invention, not intended to limit the scope thereof. Any variation and derivation from the above description and drawings should be included in the scope of the present invention.

What is claimed is:

1. A vibration snowing mechanism comprising:

a base board disposed with a driving means having an extending driving gear;

an upper fixing ring having an inner and an outer diameter and formed with multiple upper fixing holes;

a lower fixing board formed with multiple lower fixing holes corresponding to the upper fixing holes and retained above the base board;

a glass tube disposed between the upper fixing ring and the lower fixing board and filled with a liquid;

a bottom sealing pad disposed between a bottom end of the glass tube and the lower fixing board for avoiding leakage, a decoration being disposed on the bottom sealing pad;

multiple supporting columns connected with the upper fixing ring and the lower fixing board for securing the same;

an upper fitting member formed with an upper flange, a recess and a top hole and fitted with a bottom end of the upper fixing ring;

a lower fitting member formed with a lower flange, a conic receptacle and a central hole and secured at a top end of the glass tube;

a screen assembly including a sleeve fixed in the top hole of the upper fitting member, a rod member vertically slidably fitted in the sleeve, and a funnel-shaped screen member disposed at a bottom end of the rod member and formed with multiple orifices;

a vibration linkage having one end connected with the driving gear and another end fixed at a top end of the rod member; and multiple plastic granules having a diameter slightly smaller than the diameter of the orifices;

whereby when the driving gear is rotated, the vibration linkage is vibrated up and down and the screen member is also vibrated up and down, so that the multiple plastic granules pass through the orifices to drop down as snow.

2. A vibration snowing mechanism as claimed in claim 1, wherein the top end of the glass tube is formed with an annular groove for receiving the lower fitting member.

3. A vibration snowing mechanism as claimed in claim 1, wherein the driving means is a manually operated winding spring.

4. A vibration snowing mechanism as claimed in claim 1, further comprising:

a cell;

several bulbs disposed in the fixing holes of the upper fixing ring; and multiple wires connecting the bulbs with the cell.

5. A vibration snowing mechanism as claimed in claim 1, further comprising a music bell for emitting music when the driving means is activated.

* * * * *